US006716560B2

(12) United States Patent
Alexandrovich

(10) Patent No.: US 6,716,560 B2
(45) Date of Patent: Apr. 6, 2004

(54) GLOSS-CONTROLLING TONER COMPOSITIONS

(75) Inventor: Peter S. Alexandrovich, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 16 days.

(21) Appl. No.: 10/061,149

(22) Filed: Feb. 1, 2002

(65) Prior Publication Data

US 2003/0148205 A1 Aug. 7, 2003

(51) Int. Cl.[7] ..... G03G 9/087

(52) U.S. Cl. ..... 430/109.2; 430/109.3; 430/109.4; 430/111.4; 430/137.1; 430/137.21

(58) Field of Search ..... 430/111.4, 109.2, 430/109.3, 109.4, 137.1, 137.21

(56) References Cited

U.S. PATENT DOCUMENTS

| | | | | |
|---|---|---|---|---|
| 4,246,332 A | | 1/1981 | Tanaka et al. | |
| 5,082,883 A | | 1/1992 | Alexandrovich et al. | |
| 5,156,937 A | | 10/1992 | Alexandrovich et al. | |
| 5,256,507 A | * | 10/1993 | Aslam et al. | 430/42 |
| 5,518,848 A | | 5/1996 | Ito et al. | |
| 5,518,851 A | | 5/1996 | Katagiri et al. | |
| 5,556,732 A | | 9/1996 | Chow | |
| 6,168,894 B1 | | 1/2001 | Aoki et al. | |
| 6,335,135 B1 | * | 1/2002 | Arai et al. | 430/108.6 |

FOREIGN PATENT DOCUMENTS

| | | |
|---|---|---|
| EP | 745907 | 12/1996 |
| EP | 1128223 | 8/2001 |

* cited by examiner

*Primary Examiner*—Janis L. Dote

(57) ABSTRACT

A particulate toner composition comprises a dry blend of a low viscosity polymeric particulate toner component having a first selected melt viscosity and a first selected melt elasticity, and a high viscosity polymeric particulate toner component having a second selected melt viscosity and a second selected melt elasticity. The first and second melt viscosities and first and second melt elasticities are each selected so as to produce a lower variation in measured $G_{60}$ gloss values as a function of fusing temperature for fused images formed from the dry blend toner composition than the corresponding variation in measured $G_{60}$ gloss values for fused images formed from the low viscosity polymeric toner component of the composition.

26 Claims, 8 Drawing Sheets

GLOSS-CONTROLLING TONER COMPOSITIONS

FIELD OF THE INVENTION

The present invention relates to toners useful in electrostatographic processes and, more particularly, to toner compositions providing fused toner images having controlled gloss.

BACKGROUND OF THE INVENTION

In a fuser such as that used in the NEXPRESS 2100 printer, a smooth surfaced fusing roller is used to apply heat and pressure to an unfused toner image on a receiver sheet such as a clay-coated paper stock. The toner particles are fused together and adhered to the receiver sheet, and become spread out to a certain degree. The top surface of the toner deposit so produced is characterized by a degree of smoothness that can be quantified with a gloss measurement. The degree of gloss itself is important to the perception of quality of the image, and to measurable aspects such as reflection density and degree of color saturation. For a given degree of spread of the toner (measured for a specified area of white paper covered by colored toner), an increase in gloss will result in increases in reflection density and in color saturation. It is observed that, in general, as the temperature of the fuser roller is increased, the degree of gloss increases. The slope of gloss versus temperature is, however, quite steep, making it difficult to reproduce a desired gloss level on a print-to-print basis, or even within an individual print basis, because of inherent difficulties in controlling temperature fluctuations in roller fusing systems. These difficulties include, among others, fuser temperature drop in an extended run of prints resulting from heat removal by the paper, temperature overshoot when printing is temporarily stopped, temperature sensor variability, mechanical tolerance difficulties leading to greater nip width at one end of a roller compared to the other, fuser roller surfaces of varying smoothness resulting from wear or manufacturing variability, and, notably, paper stocks of variable heat capacity and water content.

It has been observed in toner/fuser systems that, for paper stocks of the glossier variety, low density areas of the toner image have a lower degree of gloss than areas of the print having higher toner laydown. It would be desirable to find toner compositions that would exhibit less of this so-called differential gloss phenomenon. Although high gloss prints have very high densities and color saturation, it is commonly perceived that they are less pleasing and of lower quality than images of a controlled mid-gloss level. Images with satin appearing gloss in the range of 10 to 40 units of the Gardiner 60 degree angle scale ($G_{60}$ gloss) are generally preferred to shiny images with higher $G_{60}$ values. Therefore it would be desirable to provide toner compositions that would readily and reproducibly produce gloss values in the desired range in the fusing system of an electrostatographic printer.

It has now been found that dry blending toner particles that have been separately prepared with a lower melt viscosity resin with toner particles that have been separately prepared with a higher melt viscosity resin produces a blended toner that manifests a substantially reduced slope of gloss versus temperature, compared to either of the pure high or low viscosity toners comprising the blend, over the mid-gloss range of interest. Such blended toners have been found to yield a lower degree of differential gloss, and provide an easy way to prepare a toner that, by selection of a blend of the proper ratio of the blend, will produce gloss values in the desired range.

The preparation of toners using blended high and low melt viscosity resins within the same toner particle is known in the art. For example, U.S. Pat. No. 4,246,332 describes the preparation of toners by melt blending a non-offsetting, high molecular weight, low fluidity styrene-acrylic resin with a high fluidity polyester or epoxy or vinyl resin in order to improve low temperature fixability. U.S. Pat. No. 5,082,883 describes a low viscosity epoxy resin melt blended with a higher viscosity polyester to produce a toner that has lower viscosity than the polyester itself, which allows low fusing temperature, but still retains some of the elastic character of the higher molecular weight branched polyester, which is desirable for conferring anti-offset properties to the toner. U.S. Pat. No. 5,156,937 describes toners comprising melt-blended low and high molecular weight polyesters that fuse at low temperatures and times characteristic of the low viscosity component, but retain enough of the melt cohesive strength of the high viscosity component so that substantially all of the toner remains adhered to the paper during hot roller fusing and thus does not offset. U.S. Pat. No. 5,518,848 describes toners prepared from melt-blended high and low molecular weight resins of specified monomer compositions in order to realize good fixing along with blocking resistance and anti-offset properties. U.S. Pat. No. 5,556,732 describes the preparation of toners by melt-blending a higher viscosity "low gloss value" polyester with a lower viscosity "high gloss value" polyester in order to achieve a toner with a gloss value intermediate to that of the pure components at a given fusing condition. U.S. Pat. No. 6,168,894 describes a toner composition formed by melt blending of a high viscosity polyester resin, sufficiently cross-linked to have an insoluble component, into a low viscosity polyester resin, wherein the high viscosity resin is phase separated within the low viscosity resin. The improvement cited is the achievement of a wide fixing range without offset.

However, since the toners of all of the aforementioned patents, the disclosures of which are incorporated herein by reference, have the same melt characteristics and composition on a particle to particle basis because of the melt blending step in their preparation, they all suffer from the difficulty of controlling gloss level due to the steepness of the gloss versus fusing temperature relationship or gloss versus fusing time relationship. It is the purpose of this invention to provide a toner having reduced sensitivity of gloss to fusing temperature and time variations.

SUMMARY OF THE INVENTION

The present invention is directed to a particulate toner composition comprising a combination of a low viscosity polymeric particulate toner component having a first selected melt viscosity and a first selected melt elasticity, and a high viscosity polymeric particulate toner component having a second selected melt viscosity and a second selected melt elasticity. The first and second melt viscosities and first and second melt elasticities are each selected so as to produce a lower variation in measured $G_{60}$ gloss values as a function of fusing temperature for fused images formed from the combination of particulate toner components than the corresponding variation in measured $G_{60}$ gloss values for fused images formed from the low viscosity polymeric particulate toner component of the composition.

The present invention is further directed to a process for forming a particulate toner composition that comprises combining a previously prepared low viscosity polymeric particulate toner component having a first selected melt viscosity and a first selected melt elasticity with a separately prepared high viscosity polymeric particulate toner component having a second selected melt viscosity and a second selected melt elasticity. The resulting toner composition provides fused images having controlled gloss characteristics.

Also in accordance with the present invention is a process for forming a fused toner image that comprises: forming on a receiver sheet an unfused toner image of the disclosed particulate toner composition, and heating the unfused toner image to a fusing temperature sufficient to form a fused toner image that, preferably, has a $G_{60}$ gloss value of about 10 to about 30 on the receiver sheet.

DETAILED DESCRIPTION OF THE INVENTION

Figure 1:
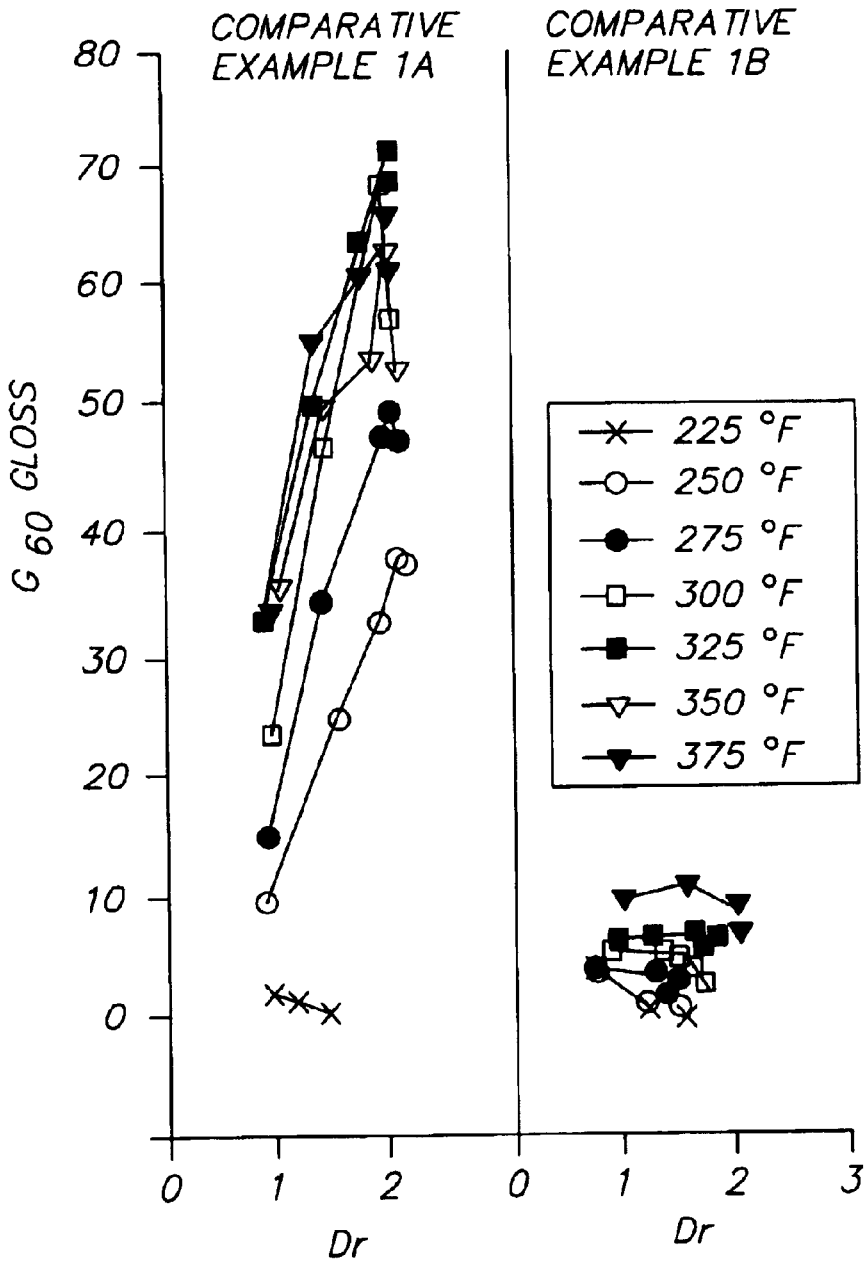
FIGS. 1 and 2 are plots of $G_{60}$ gloss values vs reflection density for, respectively, comparative examples and examples of the invention.

In the gloss-controlling particulate toner compositions of the present invention, it is postulated that the differential flow of the two types of toners within the same image is such that the higher viscosity particles are not spread out or flattened as much as the lower viscosity particles and thus act as matte particles, providing a degree of roughness of the fused toner deposit that is responsible for controlling the gloss level. A similar effect might be expected if non-fusible particles such as a silica, titania or the like were to be blended with thermoplastic toner particles of a given melt viscosity. However, if the higher viscosity matte particles are formulated as toner particles, they can be designed to have similar tribocharging properties, particle size distribution, and color properties as the lower viscosity particles. Thus, the higher and lower viscosity particles will develop at the same rate, and the covering and color properties of the image will not be affected. The terms "high viscosity particles" and "low viscosity particles" are used to describe particles that have sufficiently different gloss versus temperature characteristics in the fusing subsystem to be employed such that the inventive blends result in a reduction in the gloss versus temperature slope.

A melt viscosity is the complex viscosity of a polymer measured at a particular melt temperature and a particular frequency of oscillation. Measurements of melt viscosities and of melt elasticities, expressed as the tangent of the phase angle (tan delta), are measured using an apparatus such as a RHEOMETRICS™ melt rheometer. In accordance with the present invention, the low viscosity polymeric toner component of the particulate toner composition has a first selected melt viscosity in the range of, preferably, about 0.2 kPoise to about 5 kPoise, more preferably, about 1 kPoise to about 3 kPoise, and the high viscosity polymeric toner component has a second selected melt viscosity in the range of, preferably, about 10 kPoise to about 50 kPoise, more preferably, about 15 kPoise to about 35 kPoise, the measurements being made at a melt temperature of 120° C. and an oscillation frequency of 1 radian/second. Also in accordance with the present invention, the low viscosity polymeric component has a first selected melt elasticity, expressed as tan delta, in the range of, preferably, about 10 to about 15, and the high viscosity polymeric component has a second selected melt elasticity having tan delta in the range of, preferably, about 1 to about 3, the measurements again being made at a melt temperature of 120° C. and an oscillation frequency of 1 radian/second.

In one particular embodiment of the present invention, the higher viscosity toner particles are formulated without colorant and are applied from an additional imaging/toning subsystem so that they comprise the top layer of the unfused image. The colored toner particles, cyan, magenta, yellow, and black, for example, are formulated as the low viscosity particles, and the corresponding process color image of low viscosity particles lies beneath the layer of high viscosity transparent particles. In this manner, the gloss of the image can be "dialed" on a print to print basis by adjustment of the laydown of this clear high viscosity toner layer. This procedure can be used to, for example, prepare fused toner images that match the gloss level of paper stocks of varying gloss level. In this embodiment, it should be noted that the particles of high and low viscosities are not combined prior to image development but, instead, are blended on the receiver sheet.

In another embodiment of the invention, the high viscosity toner particles are again prepared without colorant and blended with any color low viscosity toner, such as the cyan, magenta, yellow, and black toners of a process color printing system, thus minimizing the number of different kinds of toner that must be manufactured to practice the invention.

In still another embodiment of the invention, the colored toners are prepared as combinations of low and high viscosity particles to achieve a particular desired gloss aim, while a transparent toner to be applied on top of the colored particles from an additional imaging/toning subsystem is prepared as a low viscosity formulation. In this manner, areas of the resulting fused toner image that contain the low viscosity transparent toner will be of higher gloss than other areas. This approach would allow, for example, a picture on a printed page containing text and pictures to be glossed to a higher level if the transparent low viscosity toner is applied only in that area. Alternatively, a gloss image itself could be applied on top of a picture, or blank paper, or any desired area to produce what is sometimes referred to as "spot varnish".

Preparation of the inventive toners is carried out through the normal means of toner particle formation, including the standard art of melt compounding toner ingredients such as a binder resin, colorant, charge agent, wax additive, and the like in a device such as a twin screw extruder. Particles are then prepared by pulverization on a device such as a jet mill or fluid energy mill. Surface additives such as fumed silica or titania can then be put on as a final step in a high energy dry mixing device. To practice the invention, however, steps such as those described above must be carried out twice, separately producing the low viscosity and high viscosity polymeric particulate components comprising the toner composition.

The particulate toner composition of the present invention can be prepared by dry blending the two components at the desired ratio in a dry mixing device, which does not require particularly high energy. As a practical matter, it may be preferable to separately prepare the low and high viscosity toners, and carry out the surface additive and toner blending steps together in a single step in a high shear dry mixing device. The low and high viscosity toner components can be separately prepared by chemical methods such as those described in, for example, U.S. Pat. Nos. 4,833,060, 4,835,084, 4,965,131, and 5,283,151. It is not necessary for the low and high viscosity toner particulate components that are combined in accordance with the invention to be prepared by the same method.

The toner composition can also be obtained by combining the high and low viscosity particulate toner components on a receiver sheet. For example, an image comprising colored toner particles formulated as low viscosity polymeric particles can be formed on a receiver sheet, following which high viscosity polymeric particles can be transferred to the receiver sheet to combine with the color image formed by the low viscosity polymeric toner particles.

The toner compositions of the present invention preferably comprise about 75 to about 95 weight percent of the low viscosity polymeric component and about 25 to about 5 weight percent of the high viscosity polymeric component, more preferably, about 85 to about 90 weight percent of the low viscosity component and about 15 to about 10 weight percent of the high viscosity polymeric toner component.

It is one of the advantages of the invention that the low and high viscosity toners can be prepared from ingredients that will render them of the same color and optical properties, thus allowing these aspects of image quality to be unaffected. It is advantageous to prepare the low and viscosity toners with ingredients that confer the same triboelectric properties such that they will acquire the same degree of charge either when mixed with carrier particles in a two-component development system, or when charged against a charging member such as a doctor blade in a single component development system. In this manner, they will likely develop at the same rate out of the toning device. It is particularly advantageous to prepare the low and high viscosity toners with similar particle size distribution, as this parameter is particularly important in determining the rate of development in two-component electrographic developers. Particle size, expressed as volume average diameter, is measured by conventional devices such as a COULTER MULTISIZER™, available from Coulter, Inc. Toner particles in the composition of the invention preferably have a volume average particle size of about 2 microns to about 20 microns, more preferably, about 4 microns to about 12 microns.

Realization of the different viscosity levels of the separately prepared toners to be blended is readily achieved by a number of methods. The polymeric binder resins can be of the same chemical composition, but of different molecular weight in order to achieve the desired low and high melt viscosity levels. The resins can be of different compositions but similar molecular weight such that the glass or melting transitions are different. Alternatively, the resins can be of differing degrees of branching or cross-linking, thus leading to differing degrees of melt elasticity, with a more elastic resin serving as the high viscosity toner. A "low viscosity" toner, which may include a crystalline or semi-crystalline resin or other crystalline components such as waxes, all of which tend to result in a sharp viscosity drop at the melting transition, may be combined with a "high viscosity" toner prepared from an amorphous resin that shows a more shallow viscosity versus temperature relationship at the softening transition. The low and high viscosity toners can both have crystalline content but exhibit different sharpness of melting or melting temperature characteristics. The low and viscosity toners can be prepared of the same or similar viscosity binder resins but contain different amounts of reinforcing filler materials such as clays, silicas, polymeric beads, and the like, such that they are rendered suitably different in melt viscosity. Also, the low and high viscosity toners can be prepared of the same or similar viscosity binder resins but contain different amounts of plasticizers, thus rendering them suitably different in melt viscosity. Each of the low or high viscosity toners can themselves be comprised of blends of ingredients such as those discussed above, and the ingredients can be blended at different ratios within each toner so as to achieve the desired difference in melt flow properties. It is critical to the practice of the invention that, with the chosen fusing method, one of the two blended toners must have lower flowability than the other, i.e., the "high viscosity" toner, and thus serve to provide roughness to the surface of the image, thereby allowing control of gloss level by blend ratio and rendering the sensitivity of smoothness versus temperature to be less than that which would result from use of the higher flowability toner, i.e., the "low viscosity" toner, of the blend alone. A variety of fusing methods can be used, including image contacting methods such as hot roller fusers or belt fusers, and non-contacting methods such as radiant heating, hot air heating, flash fusing, microwave fusing, and the like. The choice of viscosity levels or melt flowability of the toners of the blend can then be specifically tailored to the desired method of fusing. Preferably, fusing is carried out using an apparatus comprising a nip formed by a heated pressure roller and a heated fuser roller. Preferred fusing temperatures are preferably in the range of about 200° F. to about 400° F., more preferably, about 275° F. to about 325° F.

In the practice of the present invention, the resins used in the high and low viscosity toners can be selected from a wide variety of materials, including both natural and synthetic resins and modified natural resins, as disclosed, for example, in U.S. Pat. No. 4,076,857. The crosslinked polymers disclosed in U.S. Pat. Nos. 3,938,992 and 3,941,898 are useful, in particular, the crosslinked or noncrosslinked copolymers of styrene or lower alkyl styrenes with acrylic monomers such as alkyl acrylates or methacrylates. Vinyl resins and epoxy resins are also useful. Especially useful are condensation polymers such as polyesters. Numerous polymers suitable for use as toner resins are disclosed in U.S. Pat. No. 4,833,060. The disclosures of U.S. Pat. No. U.S. Pat. Nos. 3,938,992, 3,941,898, 4,076,857, and 4,833,060 are incorporated herein by reference.

The invention is further illustrated by the following examples.

Preparation of Low Viscosity Toners 1 and 2 and High Viscosity Toners 1, 2, 3 and 4

TABLE I describes the composition and properties of low viscosity toner 1 and high viscosity toners 1, 2, 3, and 4, which are utilized in blends in Examples 1, 2 and 3, of the invention and Comparative Example 1. Polyester toner binder resins of varying melt viscoelastic properties were obtained from the Kao Corporation of Minato Wakayama, Japan. Cyan colored toners were prepared by melt compounding and jet mill pulverizing, as follows: on a Werner and Pfleiderer model ZSK-30 twin-screw extruder, 95.5 parts by weight of binder resin was melt mixed with 7.5 parts of cyan colorant concentrate LUPRETON BLUE SE1163™, obtained from BASF Aktiengesellschaft of Ludwigshafen, Germany, along with 3 parts of BONTRON E-84™ charge agent, obtained from the Orient Corp. of Osaka, Japan. LUPRETON BLUE SE1163™ itself contains 40% by weight of copper phthalocyanine pigment, along with 60% by weight of a polyester resin, similar in melt properties to the Binder C resin used in Low Viscosity Toner 1. The extrudates were granulated on a mechanical mill and then pulverized to approximately 8 microns volume average particle size on a jet mill pulverizer, Hosakawa-Alpine Model 200AFG. The resulting toner powders were then surface treated with 1.2% by weight of R972 fumed hydrophobized silica, obtained from the Degussa Corporation of Akron, Ohio, in a Henschel FM75 high energy dry mixer, obtained from Thyssen Henschel Industrietechnik GmbH of Kassel, Germany. Melt viscosity values and melt elasticity values, the latter expressed as tangent of the phase angle (tan delta) data, of the toners were measured simultaneously on a RHEOMETRICS™ Model RDA-700 melt rheometer at 120° C. at 1 rad/sec in kiloPoise units.

TABLE I

| Example | Binder Resin | Toner Melt Viscosity* | Toner Tan Delta* |
|---|---|---|---|
| Low Viscosity Toner 1 | Binder C | 2.66 | 12.8 |
| Low Viscosity Toner 2 | Binder W-85 | 1.02 | 11.7 |
| High Viscosity Toner 1 | Binder K-4 | 18.0 | 1.58 |
| High Viscosity Toner 2 | Binder G | 30.9 | 1.48 |
| High Viscosity Toner 3 | Binder H | 30.1 | 2.22 |
| High Viscosity Toner 4 | Binder F | 27.6 | 2.72 |

*kPoise measured at 120° C., 1 radian/second

INVENTIVE EXAMPLE 1 AND COMPARATIVE EXAMPLE 1

Low Viscosity Toner 1 was blended with High Viscosity Toner 1 at weight ratios of 95/5, 90/10, 85/15 and 75/25, to produce, respectively, Examples 1A, 1B, IC, and ID of the invention. Electrographic developers were prepared with the toner blends by mixing with a strontium ferrite carrier, itself coated with a mixture of polyvinylidene fluoride and poly (methyl methacrylate) resins. Images comprising patches of varying density were prepared on an electrophotographic printing device and transferred to LUSTRO™ Laser paper, a 118 g basis weight lithographic coated paper stock obtained from the S. D. Warren Company. The printer parameters including the charging voltage, the magnetic brush bias voltage, and the toner concentration in the developer, were adjusted such that the highest density patches had a toner laydown of approximately 1 mg/cm$^2$. Images were also prepared from the two pure components, Low Viscosity Toner 1 and High Viscosity Toner 1, as Comparative Examples 1A and 1B. The images were then passed through a roller fuser apparatus at a series of temperatures; for each temperature a separate unfused toner image was used. The roller fuser apparatus comprised a heated, smooth surfaced fluoropolymer/silicone polymer blend coated fusing roller, a heated pressure roller, and drive and loading mechanisms such that a fusing nip time of 50 msec was realized. The rollers were held to the desired surface temperature by means of a temperature sensor and control circuitry. The transmission density of the fused patches was measured with a Status A red filter on an X-Rite densitometer. The gloss of each of the fused patches was measured with a Gardiner MICRO-TRI-GLOSS™ gloss meter, and the results were reported as Gardiner 60 degree gloss values, $G_{60}$. For each example, a fusing temperature series was run, with the fuser being set at 225, 250, 275, 300, 325, 350 and 375° F. Table II describes the toner compositions for Examples 1A, 1B, 1C, and 1D of the invention and for Comparative Examples 1A and 1B, and further includes the values for the slope of gloss versus temperature, measured as will be described below.

TABLE II

| Example | Weight Fraction Low Viscosity Toner 1 | Weight Fraction High Viscosity Toner 1 | Gloss Slope* $G_{60}$ units/° F. |
|---|---|---|---|
| Comparative Example 1A | 1.0 | 0 | 1.45 |
| Comparative Example 1B | 0 | 1.0 | — |
| Inventive Example 1A | 0.95 | 0.05 | 0.90 |
| Inventive Example 1B | 0.90 | 0.10 | 0.59 |
| Inventive Example 1C | 0.85 | 0.15 | 0.46 |
| Inventive Example 1D | 0.75 | 0.25 | 0.33 |

*(1 mg/cm$^2$ coverage)

FIG. 1 shows the results for Comparative Examples 1A and 1B, as plots of $G_{60}$ gloss versus reflection density Dr. Each point represents a toner patch of different density, and each line of connected points is for a given fusing temperature. For Comparative Example 1A (unblended Low Viscosity Toner 1), it is seen that, at the lowest chosen temperature of 225° F., the images are barely glossed. At the next selected temperature, 250° F., the gloss of the highest density patches already exceeds the desired range of $G_{60}$ values of about 10 to about 30. For Comparative Example 1B (unblended High Viscosity Toner 1), the minimum of the desired $G_{60}$ range is barely reached at the highest temperature of 375° F., which, because of the thermal stability of the rubber components of the fuser roll, is close to the practical upper limit of operation of the fuser. For Comparative Example 1A, the undesirable phenomenon of differential gloss is noted in, for example, the data at 250° F., where the lowest density patch has a $G_{60}$ gloss of about 9, while the highest density patches have a $G_{60}$ gloss of about 38. The paper itself has a $G_{60}$ gloss of about 32.

Figure 2:
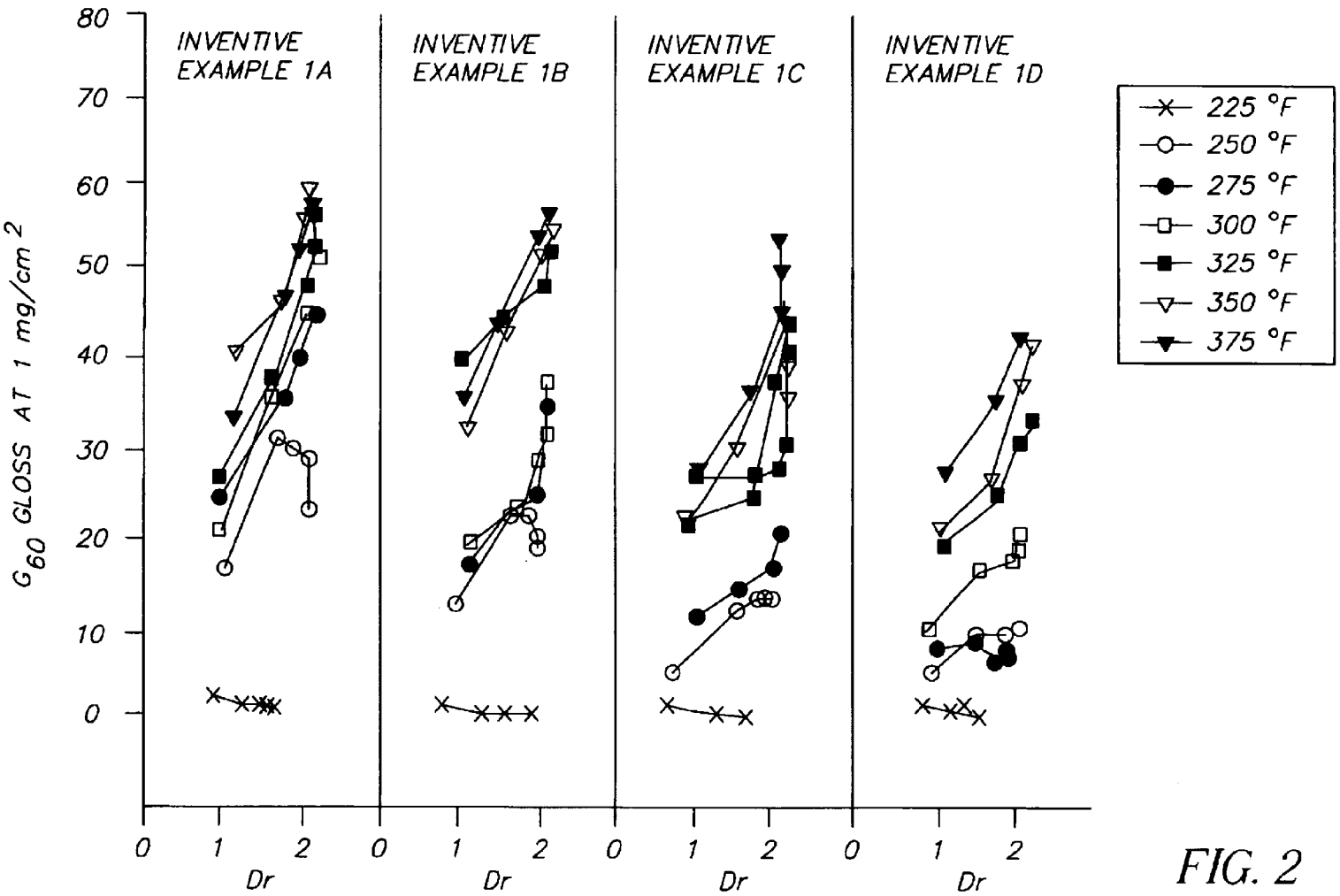

FIG. 2 shows the results for Examples 1A, 1B, 1C, and 1D of the invention as plots of $G_{60}$ gloss versus reflection density Dr. Each point represents a toner patch of different density, and each line of connected points is for a given fusing temperature. It is seen that, for a given temperature, as the amount of High Viscosity Toner 1 is increased relative to the amount of Low Viscosity Toner 1 in progressing from Example 1A through Example 1D, the $G_{60}$ gloss values decrease. Also, the differential gloss between the highest and lowest density patches of the examples of the invention is reduced relative to that of Comparative Example 1A. Furthermore, as shown by the spacing between the lines at constant temperature, the sensitivity of gloss to temperature is decreased over the 10 through 30 $G_{60}$ gloss range of interest.

Figure 3:
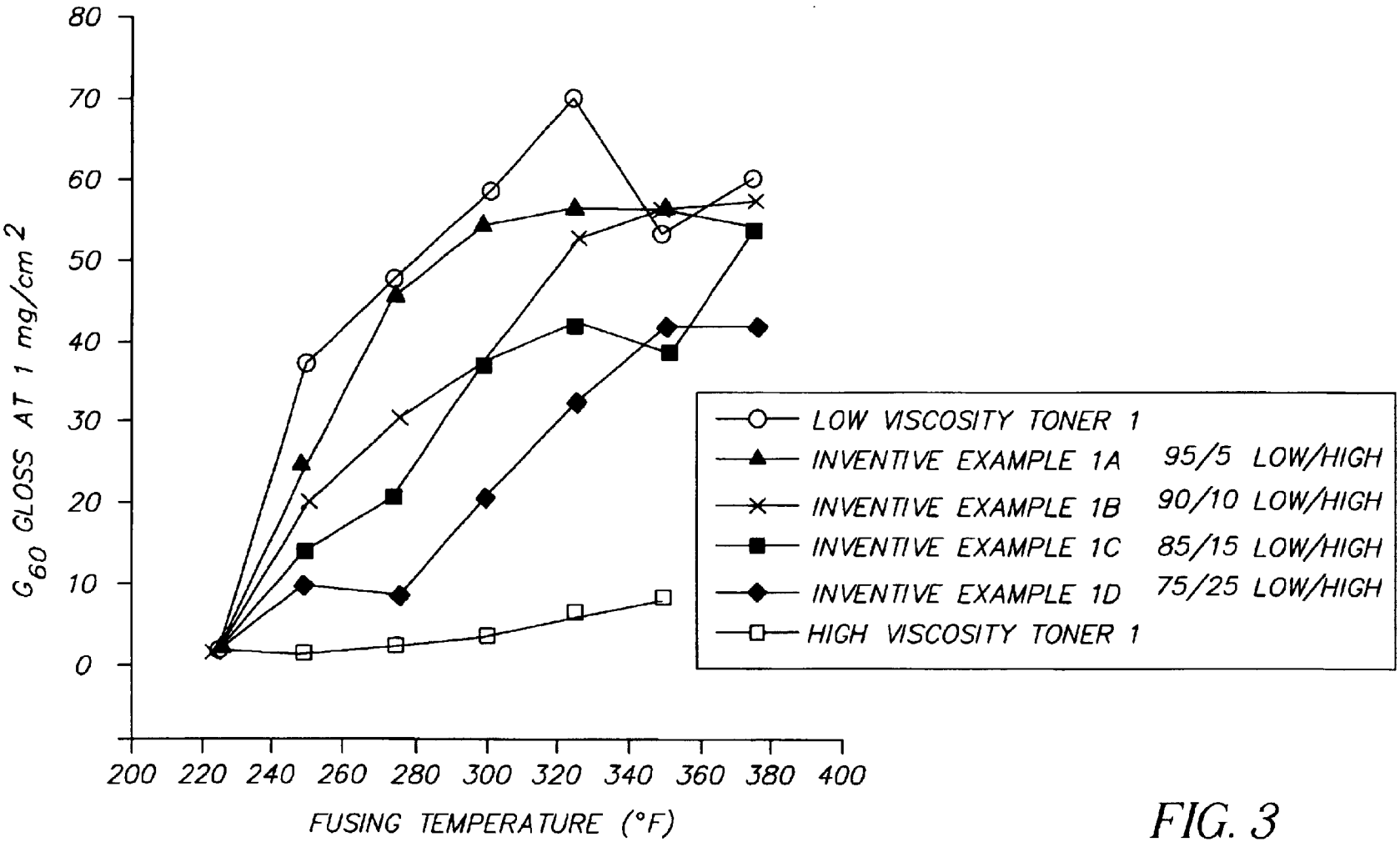
FIGS. 3, 4, and 5 are plots of $G_{60}$ gloss values vs fusing temperature for further examples of the invention.

The decrease in sensitivity of gloss to fusing temperature is one of the major advantages of the toner blends of the present invention. This is farther illustrated in FIG. 3, where the $G_{60}$ gloss values of the highest density patches from toners of Comparative Examples 1A and 1B and Examples 1A, 1B, 1C, and 1D of the invention are plotted as a function of fusing temperature. It should be noted that these data are the highest density points of the data shown in FIGS. 1 and 2, now plotted as $G_{60}$ gloss versus temperature. For a given fusing temperature, as the amount of High Viscosity Toner 1 is increased relative to the amount of Low Viscosity Toner 1 in progressing from Comparative Example 1 to Examples 1A through 1D and finally to Comparative Example 1B, the $G_{60}$ gloss values decrease, and the slopes of the lines in the gloss range of interest, approximately 10 to 30 $G_{60}$ units, also decrease. Straight lines were fitted to the data of FIG. 3 over the range of 10 to 30 $G_{60}$ gloss; the resulting slopes of gloss versus temperature are listed in TABLE II in the units of $G_{60}$ gloss/° F. of fusing temperature. The sensitivity of gloss to temperature is seen to be reduced by more than a factor of four in progressing from pure Low Viscosity Toner 1 (Comparative Example 1A) to a 0.75/0.25 Low Viscosity Toner 1/High Viscosity Toner 1 mixture (Example 1D of the invention). The value of the slope of gloss versus temperature for the pure High Viscosity Toner 1 (Comparative Example 1B) was not determined, as the gloss never reached a value of 10 over the range of test temperatures.

EXAMPLES 2 AND 3 OF THE INVENTION AND COMPARATIVE EXAMPLE 2

Blended toners were prepared in a manner identical to those of Examples 1A-1D of the invention, using pure toners as described in TABLE I. Examples 2A-2D comprise, respectively, blends of 95, 90, 85 and 75 weight % Low Viscosity Toner 1 with, respectively, 5, 10, 15 and 25 weight % High Viscosity Toner 2. Examples 3A-3D comprise, respectively, blends of 95, 90, 85 and 75 weight % Low Viscosity Toner 1 with, respectively, 5, 10, 15 and 25 weight % High Viscosity Toner 3. Comparative Examples 2A-2D comprise, respectively, blends of 95, 90, 85 and 75 weight % Low Viscosity Toner 1 with, respectively, 5, 10, 15 and 25 weight % High Viscosity Toner 4. Images were prepared and fusing experiments were carried out in the identical manner as described above for Examples 1A-1D of the invention and Comparative Examples 1A-1B.

Figure 4:
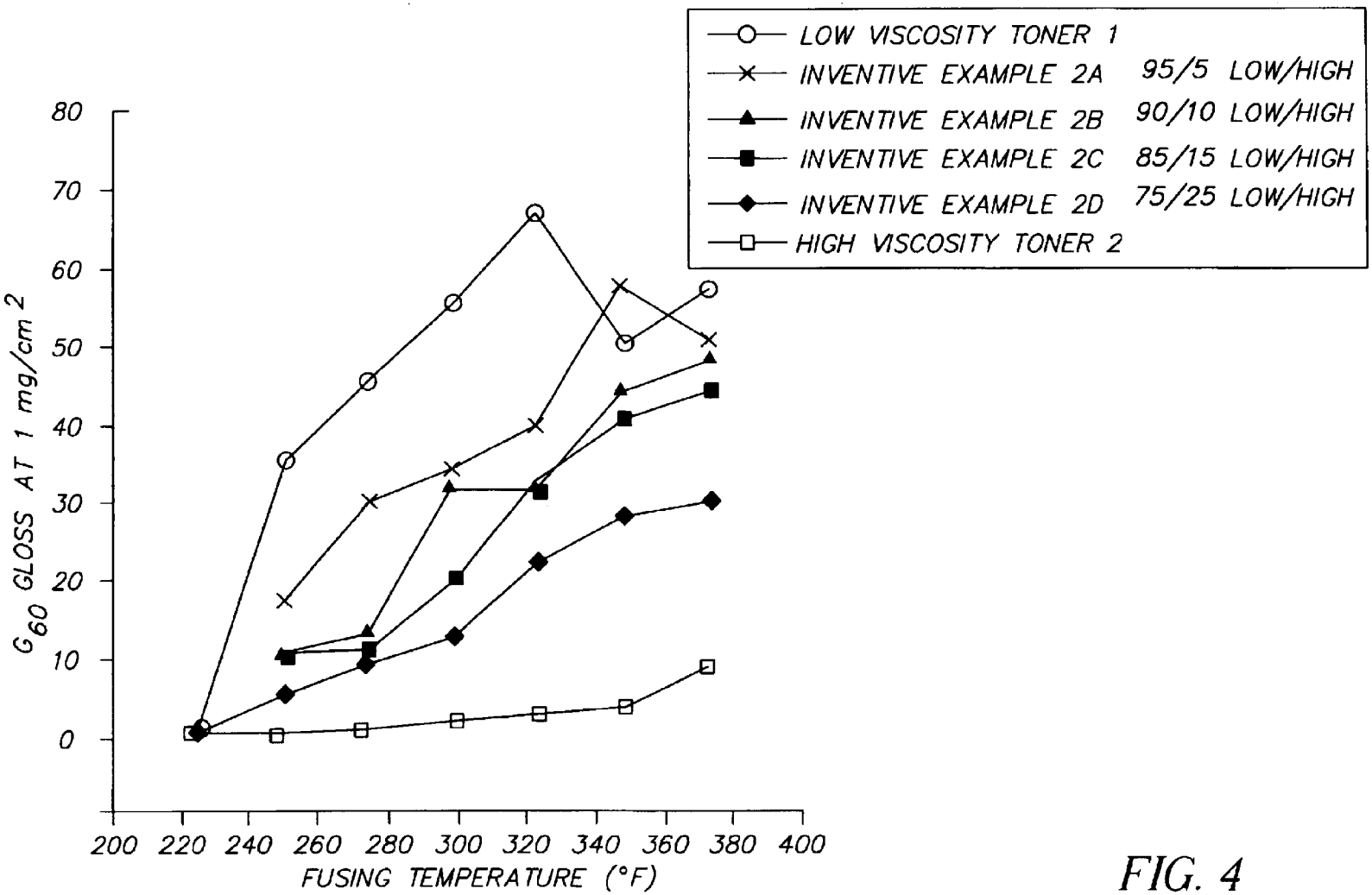
Figure 5:
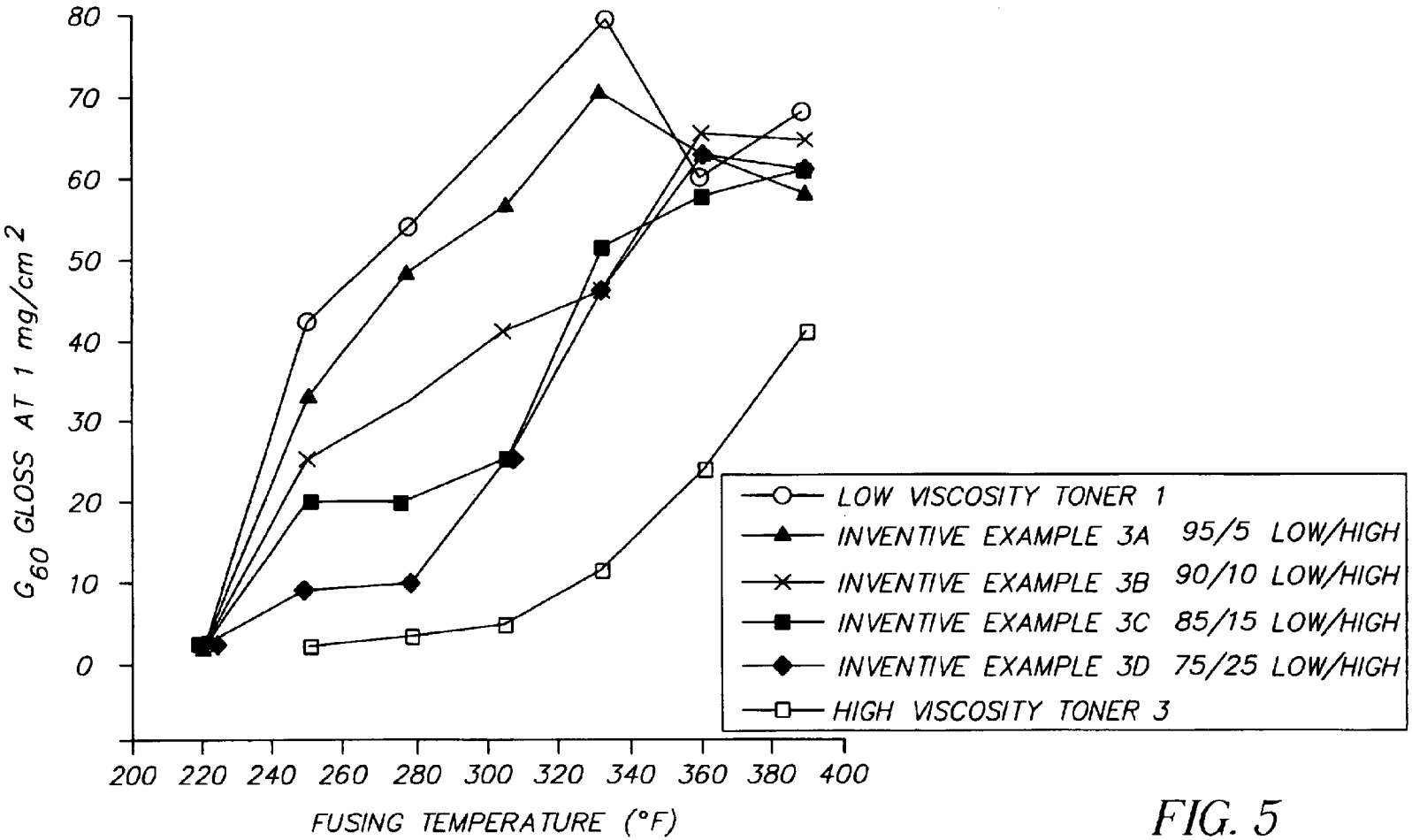

FIGS. 4 and 5 are plots of $G_{60}$ gloss, at a toner laydown of approximately 1 mg/cm$^2$, vs fusing temperature for the blended and pure toners of, respectively, Examples 2A-2D and 3A-3D. It is again seen that increasing the amount of high viscosity toner relative to low viscosity toner reduces the gloss level and the slope of gloss versus temperature.

Figure 6:
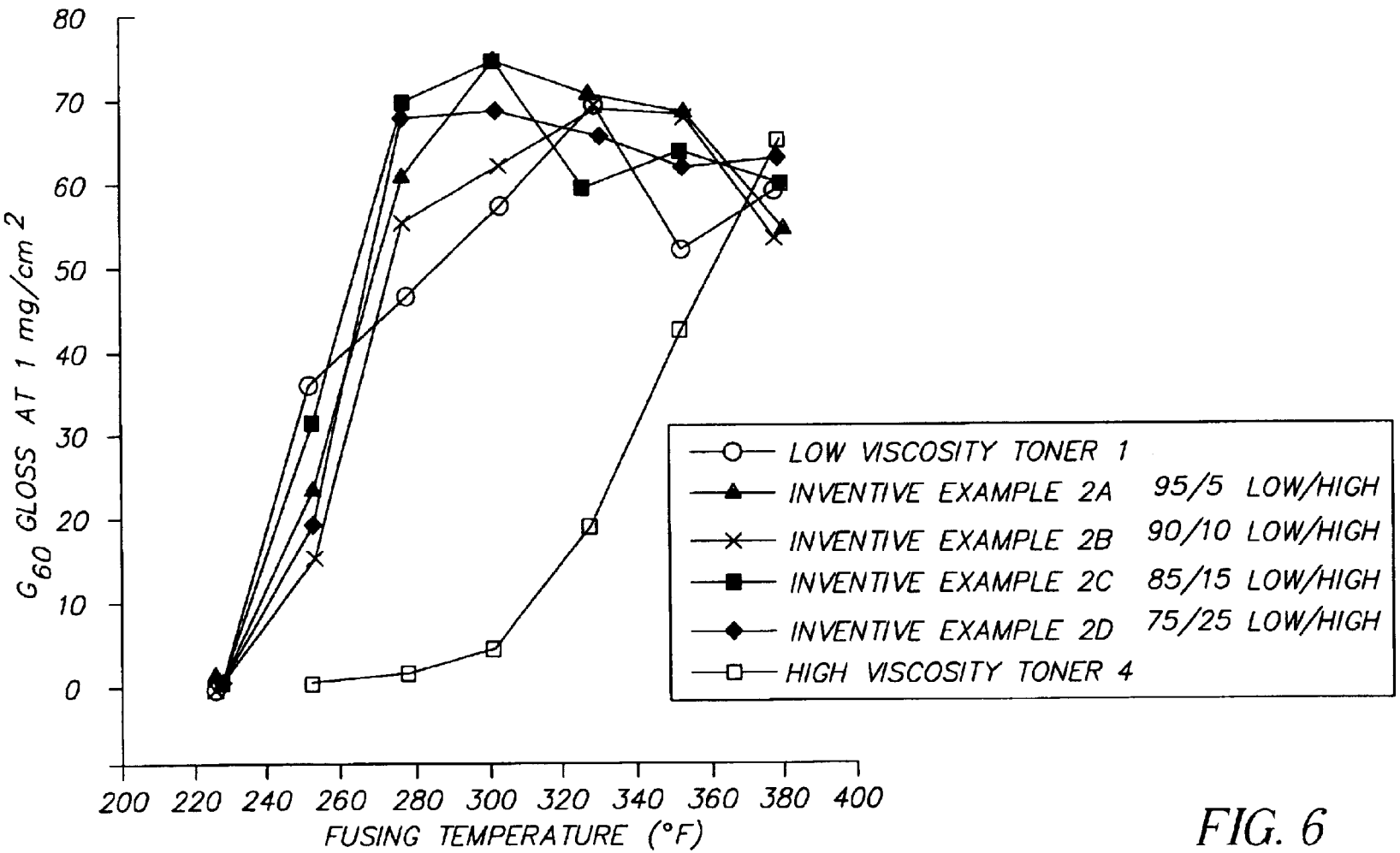
FIG. 6 is a plot of $G_{60}$ gloss values vs fusing temperature for another comparative example.

FIG. 6 is a plot of $G_{60}$ gloss, at a toner laydown of approximately 1 mg/cm$^2$, vs fusing temperature for the blended and pure toners of Comparative Examples 2A-2D. For these examples, no reduction in gloss or in the slope of gloss versus temperature was observed for the various blends of High Viscosity Toner 4 with Low Viscosity Toner 1. Apparently the difference in fusing characteristics between these two pure toners is not great enough for the beneficial effect provided by the present invention to be observed. Examination of TABLE I reveals that High Viscosity Toner 4 has a higher viscosity but a lower melt elasticity (indicated by the higher value of tan delta) than High Viscosity Toner 1. The melt flow properties of High Viscosity Toner 1 are sufficiently different from those of Low Viscosity Toner 1 that their blends produce the inventive effect observed with Examples 1A–D of the invention. It is therefore apparent that both melt viscosity and melt elasticity differences are important in determining whether two toners can be blended together to achieve the desired inventive result.

Straight lines were fitted to the data of FIGS. 4, 5, and 6 over the range of 10 to 30 $G_{60}$ gloss; the resulting slopes of gloss versus temperature are listed in Table III in the units of $G_{60}$ gloss/° F. fusing temperature.

TABLE III

| % Low Viscosity Toner 1 | Examples 2 of the Invention Low Viscosity Toner 1 plus High Viscosity Toner 2 Gloss vs Temperature Slope G60 units/° F. | Examples 3 of the Invention Low Viscosity Toner 1 plus High Viscosity Toner 3 Gloss vs Temperature Slope G60 units/° F. | Comparative Examples 2 Low Viscosity Toner 1 plus High Viscosity Toner 4 Gloss vs Temperature Slope G60 units/° F. |
|---|---|---|---|
| 100 | 1.45 | 1.45 | 1.45 |
| 95 | (A) 1.00 | (A) 1.05 | (A) 1.52 |

TABLE III-continued

| % Low Viscosity Toner 1 | Examples 2 of the Invention Low Viscosity Toner 1 plus High Viscosity Toner 2 Gloss vs Temperature Slope G60 units/° F. | Examples 3 of the Invention Low Viscosity Toner 1 plus High Viscosity Toner 3 Gloss vs Temperature Slope G60 units/° F. | Comparative Examples 2 Low Viscosity Toner 1 plus High Viscosity Toner 4 Gloss vs Temperature Slope G60 units/° F. |
|---|---|---|---|
| 90 | (B) 0.40 | (B) 0.63 | (B) 1.70 |
| 85 | (C) 0.26 | (C) 0.26 | (C) 1.42 |
| 75 | (D) 0.22 | (D) 0.39 | (D) 1.30 |
| 0 | | 0.40 | 0.78 |

EXAMPLE 4 OF THE INVENTION

Figure 7:
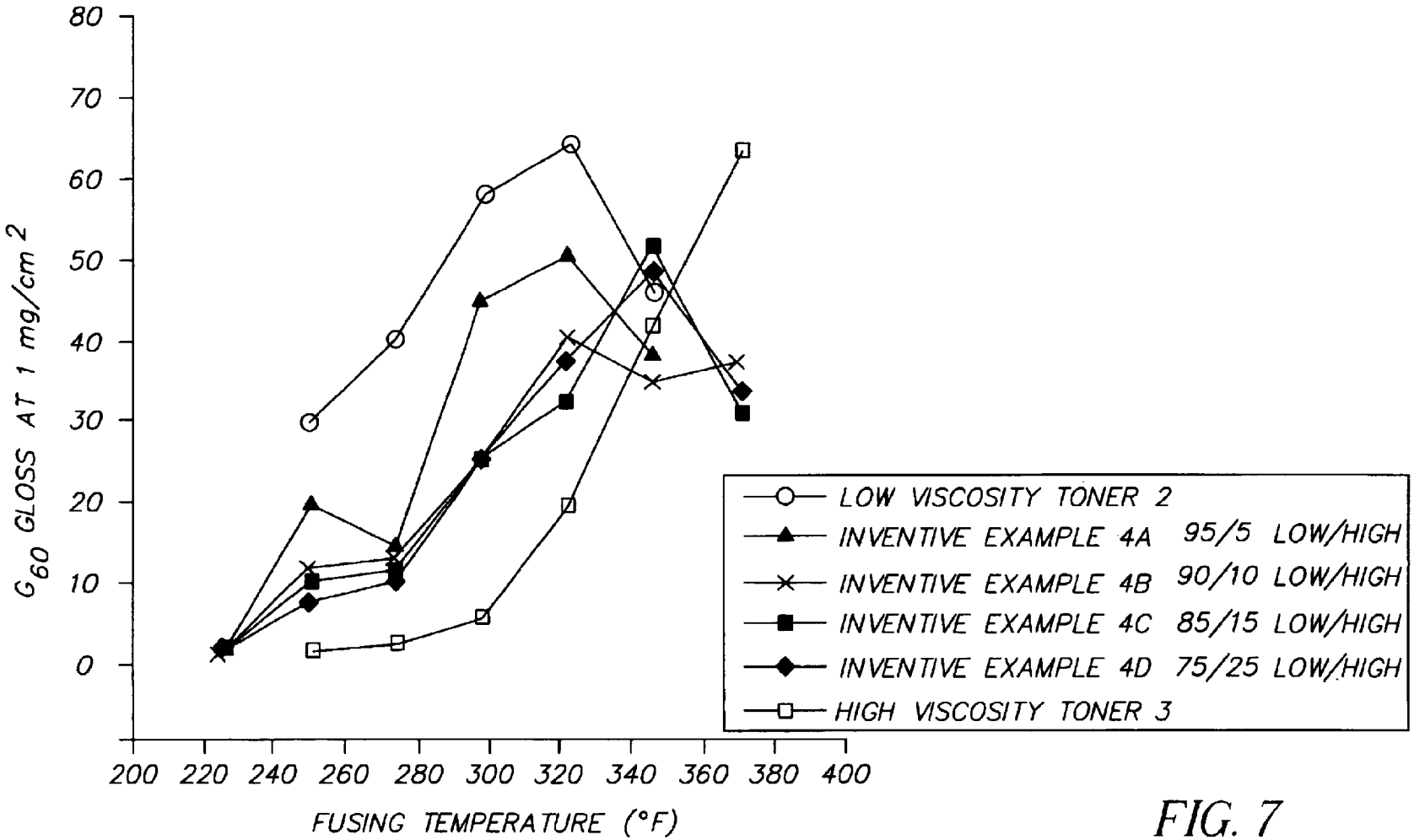
FIG. 7 is a plot of $G_{60}$ gloss values vs fusing temperature for another example of the invention.

Blended toners were prepared in a manner identical to those of Examples 1A-1D of the invention, using pure toners as described in TABLE I. Examples 4A-4D of the invention comprise, respectively, blends of 95, 90, 85 and 75 weight % Low Viscosity Toner 2 with, respectively, 5, 10, 15 and 25 weight % High Viscosity Toner 4. Images were prepared and fusing experiments were carried out in the identical manner as described above for Examples 1A-1D of the invention and Comparative Examples 1A-1D. FIG. 7 is a plot of $G_{60}$ gloss, at a toner laydown of approximately 1 mg/cm$^2$, vs fusing temperature for the blended and pure toners of Examples 4A-4D of the invention. Here it is seen that increasing the amount of high viscosity toner relative to low viscosity toner reduces the gloss level and the slope of gloss versus temperature. Examples 4A-4D of the invention and Comparative Examples 2A-2D use the same low melt flowability toner, High Viscosity Toner 4, but different high melt flowability toners: Low Viscosity Toner 1 in Comparative Examples 2A-2D, and Low Viscosity Toner 2 in Examples 4A-4D of the invention. Examination of the data in TABLE I reveals that Low Viscosity Toner 2 has a lower viscosity, by a factor of about 2.5, than Low Viscosity Toner 1, but, on the basis of their tan delta values, they are of similar melt elasticity. Apparently, a large enough difference between the melt flow behavior of Low Viscosity Toner 2 and that of High Viscosity Toner 4 exists so that their blends exhibit the desired gloss controlling inventive effect.

Examination of FIGS. 5 and 6 reveals that High Viscosity Toners 3 and 4 are sufficiently low in viscosity to produce a substantial level of gloss in the range of temperatures tested. The values of the slope of $G_{60}$ gloss versus temperature for these two unblended toners included in TABLES II and III reveals that they have a lower sensitivity of gloss to temperature than do the pure unblended Low Viscosity Toners 1 and 2, as shown in FIGS. 2 and 7. However, they achieve the desired range of $G_{60}$ gloss of about 10 to about 30 at much higher fusing temperatures than is possible with the inventive blended toners. For example, High Viscosity Toner 3 has a gloss versus temperature slope of 0.40 (see TABLE III), and reaches a $G_{60}$ value of 20 at about 350° F. (see FIG. 5). In Example 2B of the invention, however, a 90/10 blend of Low Viscosity Toner 1 with High Viscosity Toner 2 has the same gloss versus temperature slope of 0.40 but attains a $G_{60}$ value of 20 at about 285° F. (see FIG. 4), which is about 65° F. lower than that required with pure High Viscosity Toner 3. Thus, the present invention enables a desirable low slope of gloss versus temperature to be achieved at much lower fusing temperatures than is possible with pure unblended toners.

EXAMPLE 5 OF THE INVENTION AND COMPARATIVE EXAMPLE 3

The advantage of toner compositions prepared, in accordance with the present invention, by blending separately prepared toners of high and low viscosity over toner compositions prepared by conventional melt blending of exactly the same ingredients at the same overall blend compositions is demonstrated by comparing the results from Example 5 of the invention and Comparative Example 3. Example 5 of the invention comprises toners prepared by dry blending Low Viscosity Toner 3, based on Binder C resin, with High Viscosity Toner 5, based on Binder N resin. Binder C and Binder N are both polyester resins obtained from the Kao Corporation of Minato Wakayama, Japan. Low Viscosity Toner 3 was prepared on the identical equipment used to prepare Low Viscosity Toner 1, as previously described. High Viscosity Toner 5 was prepared by melt compounding on a two-roll mill, and pulverizing on a Trost model TX jet mill. Examples 5A-5C of the invention comprise blends containing, respectively, 8, 15, and 33 weight % of the Binder N-based high viscosity toner in the Binder C-based low viscosity toner.

Comparative Examples 3A-3C comprise toners prepared by melt compounding together High Viscosity Toner 5 with Low Viscosity Toner 3 on a two-roll mill, and pulverizing on a jet mill, such that the three compositions contained, respectively, 8, 15, and 33 weight % of High Viscosity Toner 5 in Low Viscosity Toner 3.

Figure 8:
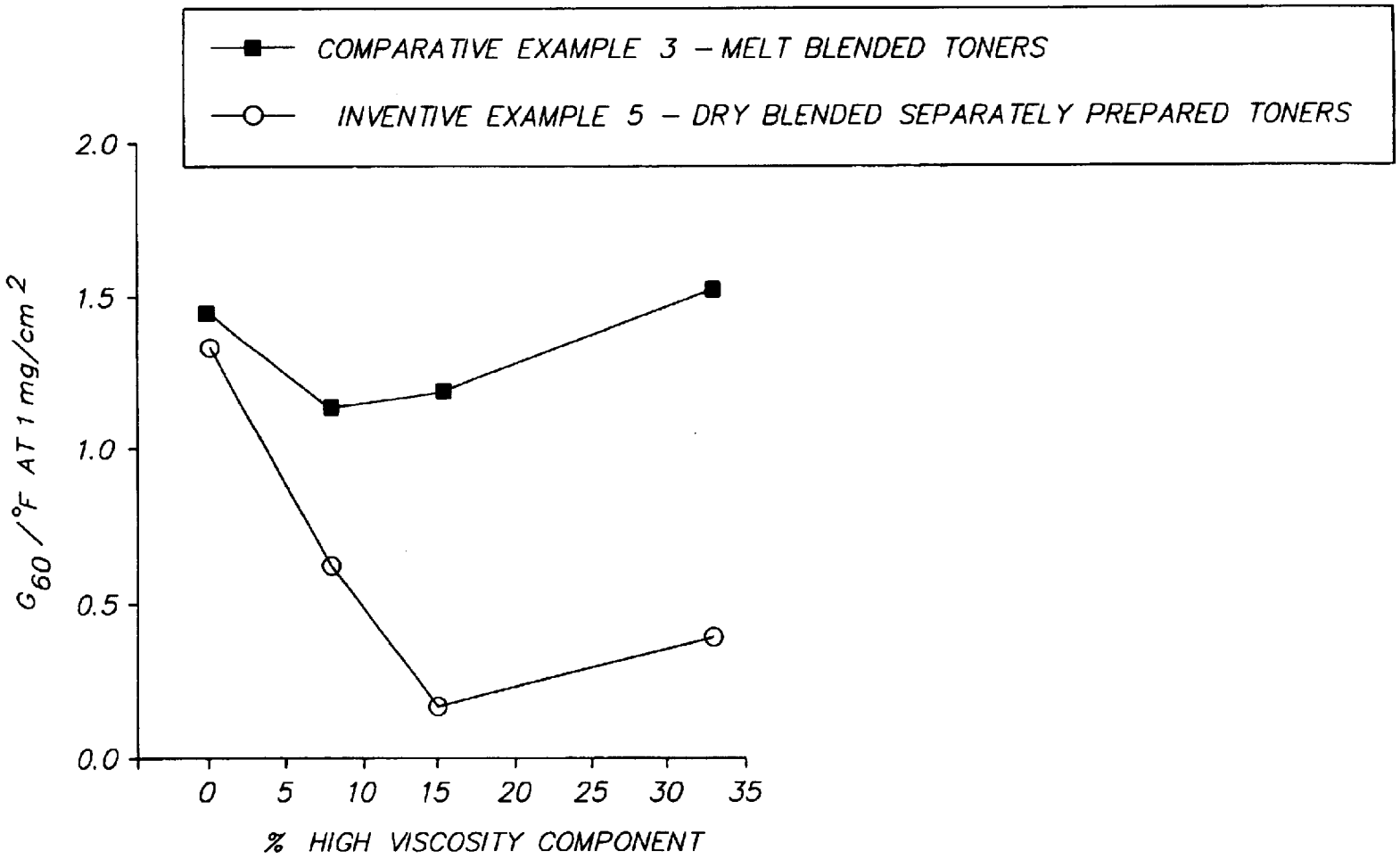
FIG. 8 is a plot of gloss-temperature slope vs the amount of high viscosity polymeric content for comparative toner compositions and toner compositions of the present invention.

Images comprising patches on paper were prepared as in previous examples, then fused at a series of temperatures such that the slope of $G_{60}$ gloss versus temperature at a toner coverage of approximately 1.0 mg/cm$^2$ could be measured in the same way as previous examples. As shown in FIG. 8, the slope of $G_{60}$ gloss versus temperature is desirably reduced for Examples 5A-5C of the invention but not substantially reduced by Comparative Examples 3A-3C, which had been prepared by melt blending the high viscosity Binder N resin into the low viscosity Binder C resin.

The invention has been described in detail with particular reference to preferred embodiments thereof, but it will be understood that variations and modifications can be effected within the spirit and scope of the invention, which is defined by the claims that follow.

What is claimed is:

1. A particulate toner composition comprising:

a combination comprising a dry blend of a low viscosity polymeric particulate toner component having a first selected melt viscosity and a first selected melt elasticity, and a high viscosity polymeric particulate toner component having a second selected melt viscosity and a second selected melt elasticity;

wherein said first melt viscosity, said first melt elasticity, said second melt viscosity, and said second melt elasticity are each selected to lower the variation in measured $G_{60}$ gloss values as a function of fusing temperature for fused images formed from said toner composition relative to the variation in measured $G_{60}$ gloss values as a function of fusing temperature for fused images formed from said low viscosity polymeric particulate toner component.

2. The toner composition of claim 1 wherein said first selected melt viscosity is in the range of about 0.2 kPoise to about 5 kPoise, and said second selected melt viscosity is in the range of about 10 kPoise to about 50 kPoise, said melt viscosities being measured at a melt temperature of 120° C. and an oscillation frequency of 1 radian/second.

3. The toner composition of claim 2 wherein said first selected melt viscosity is in the range of about 1 kPoise to about 3 kPoise, and said second selected melt viscosity is in the range of about 15 kPoise to about 35 kPoise.

4. The toner composition of claim 1 wherein said first selected melt elasticity has a tangent of the phase angle (tan delta) value in the range of about 10 to about 15, and said second selected melt elasticity has a tangent of the phase angle (tan delta) value in the range of about 1 to about 3, said melt elasticities being measured at a melt temperature of 120° C. and an oscillation frequency of 1 radian/second.

5. The toner composition of claim 1 wherein at least one of said low viscosity polymeric particulate toner component and said high viscosity polymeric particulate toner component comprises a colorant.

6. The toner composition of claim 5 wherein at least one of said low viscosity polymeric particulate toner component and said high viscosity polymeric particulate toner component further comprises a charge agent.

7. The toner composition of claim 1 comprising about 75 to about 95 weight percent of said low viscosity polymeric particulate toner component and about 25 to about 5 weight percent of said high viscosity polymeric particulate toner component.

8. The toner composition of claim 7 comprising about 85 to about 90 weight percent of said low viscosity polymeric particulate toner component and about 15 to about 10 weight percent of said high viscosity polymeric particulate toner component.

9. The toner composition of claim 1 wherein each of said low viscosity and high viscosity polymeric particulate toner components independently comprises a resin selected from the group consisting of vinyl resins, styrene-acrylic resins, epoxy resins, and polyester resins.

10. The toner composition of claim 9 wherein each of said low viscosity and high viscosity polymeric particulate toner components independently comprises a polyester resin.

11. The toner composition of claim 1 wherein each of said polymeric particulate toner components comprises a surface additive.

12. The toner composition of claim 11 wherein said surface additive comprises silica.

13. The toner composition of claim 1 comprising toner particles having a volume average particle size of about 2 microns to about 20 microns.

14. The toner composition of claim 13 comprising toner particles having a volume average particle size of about 4 microns to about 12 microns.

15. A process for forming a particulate toner composition that provides fused images having controlled gloss characteristics, said process comprising:

combining a previously prepared low viscosity polymeric particulate toner component having a first selected melt viscosity and a first selected melt elasticity with a separately prepared high viscosity polymeric particulate toner component having a second selected melt viscosity and a second selected melt elasticity, said combining comprises dry blending said low viscosity polymeric particulate toner component and said high viscosity polymeric particulate toner component;

wherein said first melt viscosity, said first melt elasticity, said second melt viscosity, and said second melt elasticity are each selected to lower the variation in measured $G_{60}$ gloss values as a function of fusing temperature for fused images formed from said toner composition relative to the variation in measured $G_{60}$ gloss values as a function of fusing temperature for fused images formed from said low viscosity polymeric particulate toner component.

16. The process of claim 15 wherein said first selected melt viscosity is in the range of about 0.2 kPoise to about 5 kPoise, and said second selected melt viscosity is in the range of about 10 kPoise to about 50 kPoise, said melt viscosities being measured at a melt temperature of 120° and an oscillation frequency of 1 radian/second.

17. The process of claim 16 wherein said first selected melt viscosity is in the range of about 1 kPoise to about 3 kPoise, and said second selected melt viscosity is in the range of about 15 kPoise to about 35 kPoise.

18. The process of claim 15 wherein said first selected melt elasticity has a tangent of the phase angle (tan delta) value in the range of about 10 to about 15, and said second selected melt elasticity has a tangent of the phase angle (tan delta) value in the range of about 1 to about 3, said melt elasticities being measured at a melt temperature of 120° C. and an oscillation frequency of 1 radian/second.

19. The process of claim 15 wherein at least one of said low viscosity polymeric particulate toner component and said high viscosity polymeric particulate toner component comprises a colorant and a charge agent.

20. The process of claim 15 wherein each of said low viscosity and said high viscosity polymeric particulate toner components comprises a surface additive.

21. The process of claim 15 wherein said toner composition comprises about 75 to about 95 weight percent of said low viscosity polymeric particulate toner component and about 25 to about 5 weight percent of said high viscosity polymeric particulate toner component.

22. The process of claim 21 wherein said toner composition comprises about 85 to about 90 weight percent of said low viscosity polymeric particulate toner component and about 15 to about 10 weight percent of said high viscosity polymeric particulate toner component.

23. The process of claim 15 wherein each of said low viscosity and high viscosity polymeric particulate toner components independently comprises a polyester resin.

24. The process of claim 23 wherein said toner composition comprises about 75 to about 95 weight percent of said low viscosity polymeric particulate toner component and about 25 to about 5 weight percent of said high viscosity polymeric particulate toner component.

25. The process of claim 24 wherein said toner composition comprises about 85 to about 90 weight percent of said low viscosity polymeric particulate toner component and about 15 to about 10 weight percent of said high viscosity polymeric particulate toner component.

26. The process of claim 15 wherein said toner composition comprises toner particles having a volume average particle size of about 2 microns to about 20 microns.

* * * * *